United States Patent [19]

Sutton, III

[11] Patent Number: 4,659,324

[45] Date of Patent: Apr. 21, 1987

[54] CENTRIFUGE ROTOR WITH AN OFFSET PIVOTAL MOUNT FOR A SAMPLE CONTAINER

[75] Inventor: John H. Sutton, III, Belmont, Calif.

[73] Assignee: Beckman Instruments, Inc., Fullerton, Calif.

[21] Appl. No.: 616,644

[22] Filed: Jun. 4, 1984

[51] Int. Cl.[4] ..... B04B 5/02

[52] U.S. Cl. ..... 494/20

[58] Field of Search ..... 494/20, 16, 17; 210/360.1, 361; 422/102

[56] References Cited

U.S. PATENT DOCUMENTS

| | | | |
|---|---|---|---|
| 1,663,690 | 3/1928 | Raass | 494/20 |
| 1,713,579 | 5/1929 | Wightman | 233/29 |
| 1,991,925 | 2/1935 | Garver | 233/26 |
| 3,951,334 | 4/1976 | Fleming | 494/20 |
| 3,981,438 | 9/1976 | Weyant | 494/20 |
| 4,147,294 | 4/1979 | Davidson | 233/26 |

FOREIGN PATENT DOCUMENTS

| | | |
|---|---|---|
| 2009633A | 6/1979 | United Kingdom . |

*Primary Examiner*—Robert W. Jenkins

*Attorney, Agent, or Firm*—William H. May; Paul R. Harder; Steven R. Markl

[57] ABSTRACT

A centrifuge rotor is presented having a pivotal mount for a sample container upwardly offset from the radial plane of maximal strength of the rotor permitting a smaller diameter rotor container assembly and reducing exposed surface area of the rotor container assembly.

4 Claims, 3 Drawing Figures

CENTRIFUGE ROTOR WITH AN OFFSET PIVOTAL MOUNT FOR A SAMPLE CONTAINER

TECHNICAL FIELD

The present invention pertains to centrifuge apparatus and, in particular, to centrifuge rotors which comprise a pivotal mount and assembly for a sample container.

BACKGROUND ART

In scientific research, a centrifuge is used to separate a mixture of substances, often in liquid form or suspension, into individual components according to their specific mass. This is accomplished by generating a high centrifugal force field which acts on the mixture causing heavier components to separate from lighter components.

A centrifugal force field is generated by spinning a sample mixture about a distal axis in a centrifuge. The centrifuge comprises a rotor, to which sample containers are attached for holding a sample mixture. The containers are generally pivotally attached to the rotor so they may swing outwardly under effect of centrifugal force maintaining the bottom of the container generally toward the direction of centrifugal force. This is necessary since the containers must contain liquid mixtures in the presence of gravitational force during inoperative periods of the centrifuge and in the presence of both gravitational and a centrifugal force field during operative periods. The pivotal mount permits the sample container to hang free, supporting a sample liquid in the presence of gravity, and permits the container to swing outwardly when the centrifugal force field is applied, to a generally horizontal position, to contain the fluid mixture against the combined forces where centrifugal force may be one hundred times the magnitude of gravitational force. The container is also generally removable from a centrifuge rotor for quick and easy replacement of samples and cleaning.

Thus, the mounting which connects the sample container to the rotor must provide pivotal freedom about an axis perpendicular to the centrifugal force field generated by spinning the rotor, and must permit removal of the container from the rotor without difficulty.

Generally, the greater the magnitude of centrifugal force field that can be generated, the more rapidly and accurately a centrifuge can operate to accomplish mixture separation. The magnitude of the centrifugal force field is limited by a number of factors. These factors generally relate to the speed with which the rotor of the centrifuge may be turned. Specifically, these factors may include the power available for driving the rotor, a diametral size of the rotor, the strength of the rotor construction, etc. For instance, increasing the radius of the rotor while maintaining the same rotational speed, increases the centrifugal force field. Similarly, for a rotor of a specific diametral size, increasing the rotational speed increases the centrifugal force field. Each of these variations, however, has characteristic limitations. Consider that the larger the diameter is of a centrifuge rotor, the greater the strength of the structure comprising a rotor must be to survive increases in centrifugal force at a selected rotational speed, due to increase in rotor radius and the effect of increased rotor structure weight.

Considering small bench top type centrifuges, much higher rotational speeds are required to generate sufficient centrifugal force fields to perform sample separation. Higher rotational speeds, however, generally result in much higher windage drag on the exposed surface of the outer portions of the rotor and mounted containers. Increased windage drag significantly increases power requirements for driving the rotor at the desired rotational speed. Since the diametral size of a rotor of a small tabletop centrifuge is determined by size constraints, as is the power source available for driving the rotor, the speed with which the rotor may be turned becomes dependent upon the windage drag generated. Windage drag effects are related to the streamline of the physical shape and structural characteristics of the rotor and container assembly. Because no, or only a partial, vacuum condition is usually present within most small tabletop centrifuges, the windage drag most often becomes a critical limitation to centrifuge performance.

Windage drag is determined by the surface area and the streamline of the shape of the rotor and container assembly. Thus, reducing the surface area or improving the streamline of assembly shape reduces windage drag and increases rotational speed under constant power. Through improvements in these factors, the force field generated may be increased.

In the past, due to strength considerations of rotor structure, the positions of the pivotal mounts for a sample container have been located radially outwardly between adjacent arms of the rotor, on a radial plane orthogonal with the axis of rotation and positioned through the portion of the rotor having maximal structural strength such that the arms of the rotor are maintained in radial tensile load when a centrifugal force field is generated and acts on the rotor mounting sample container and sample. Generally, this requires the containers to be pivotally mounted between the ends of a pair of adjacent rotor arms, outwardly from a yoke portion formed therebetween, to eliminate any problems of interference of pivotal movement of the container and mounting with the rotor.

The generally standard radial construction of a centrifuge rotor, however, exposes a great deal of rotor and container surface area at wide radial positions, which increases the effect of windage drag due to large surface exposure at high tangential velocity. With this construction, therefore, the rotor speed and thus the centrifugal force field which the centrifuge is capable of generating, is limited due to the size of the rotor structure which is necessary to provide sufficient strength to support the containers in the presence of the force field generated.

DISCLOSURE OF THE INVENTION

The present invention is a rotor for a centrifuge which is constructed to provide a pivotal mount for a sample container which is upwardly offset from the radial plane of maximal rotor strength. This rotor construction permits the diametral size and exposed surface area of the rotor and container assembly to be significantly reduced, without interference of the pivotal movement necessary between the container and rotor, reducing the effect of windage drag. Surface area and diametral size reduction is accomplished by constructing the rotor arms with a generally L-shape at the outermost portion to provide arm structure above the radial plane of maximal strength, for pivotal mounting of a sample container. L-shaped arm construction reduces the radial length of each arm to eliminate an outer portion of the arm which heretofore was necessary to avoid interference when a sample container pivoted. Furthermore, maximum radius of a rotor-container assembly, with containers pivoted to horizontal position under effect of centrifugal force is reduced. The offset location of the pivotal mounting for the container on the rotor creates the smallest possible diametral size and reduces exposed surface area for any container size, limited only by the geometry of the pivotal movement of the container during centrifuge operation.

BEST MODE OF THE INVENTION

Figure 1:
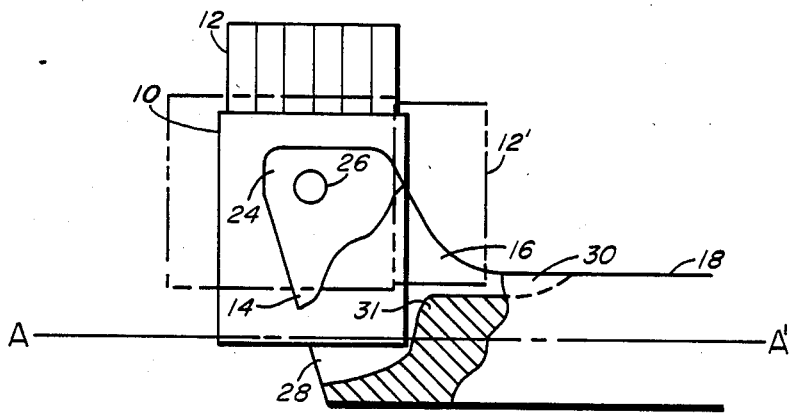
FIG. 1 depicts a side view of a rotor arm pivotably mounting a sample container in a first non-operational state position shown by solid line and a second operational state position in which a centrifugal force field is acting on the sample container and has pivoted the container to a substantially horizontal position, shown by the container depicted in broken line. The rotor arm further has a removed segment in order to depict the intermediate construction of the rotor arm and yoke.

The structure of a rotor comprising the present invention can be described with reference to FIG. 1. FIG. 1 depicts a single arm-container assembly of a centrifuge rotor, comprising a sample container 10 for receiving a sample load 12 pivotally mounted between a pair of adjacent bifurcated arms 14 and 16, extending from the rotor yoke 18. The arms 14, 16 of the rotor extend generally outwardly along a radial line identified as A—A', which line lies in the radial plane of maximal strength of the rotor. A centrifugal force field is generated in a direction parallel to line A—A' toward the outward direction of the arms 14, 16 when the rotor is turned at. high rotational speed. A distal end of each arm, identified as 24, is constructed in an upward L-shape to provide a location for a mounting pin 26 which is offset upwardly from the radial plane of maximal strength, identified by line A—A'. The mounting pin 26 receives a sample container 10 positioned between adjacent arms 14 and 16 and acts to pivotably mount the container 10 permitting the container to hang freely depicted with solid lines. When the centrifuge is operated and the rotor is turned at high rotational speed to generate a high centrifugal force field, the sample container 10 pivots to a substantial horizontal position, as shown in the container 10' depicted with broken lines.

Figure 3:
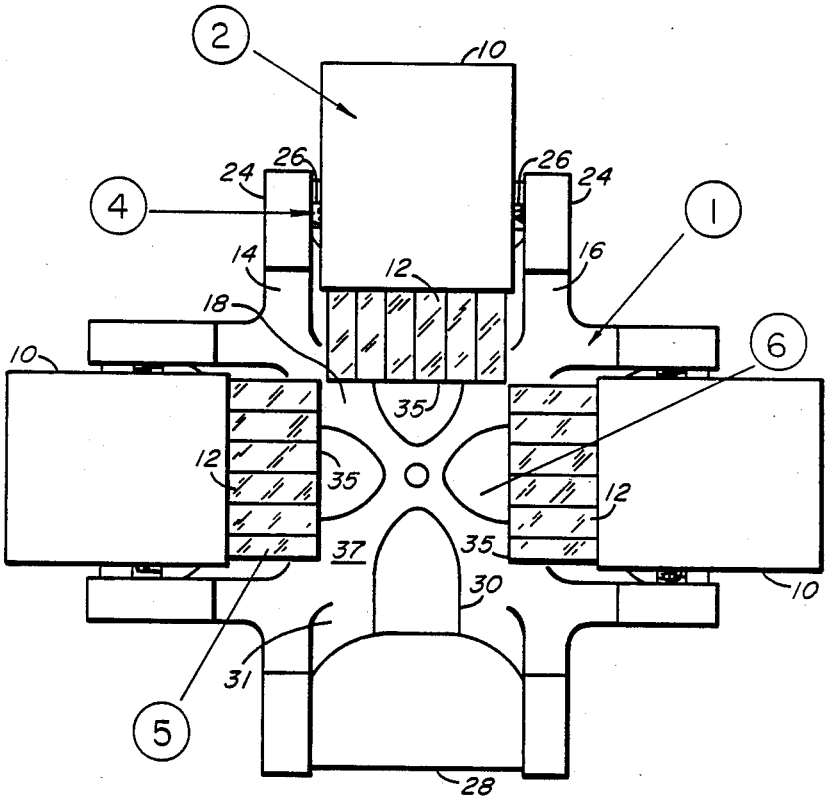
FIG. 3 is a top plan view of the presented rotor and container assembly during operation of a centrifuge when a centrifugal force field is acting on the sample containers. The lowermost sample container is removed from the drawing to show the structural configuration of the rotor.

Referring to the top arm-container assembly of the centrifuge rotor assembly depicted in FIG. 3, the upright ends 24 of the bifurcated rotor arms 14, 16 are shown, each of which have an inwardly extending mounting pin 26. The birfucated arms 14, 16 are spaced to provide an area into which a container 10 can be received and pivotably mounted upon the inwardly extending pins 26.

The central portion of the rotor interior, identified as yoke 18 from which the bifurcated arms 14, 16 extend, is provided with two recesses 28 and 30, clearly shown in the lowermost container position of FIG. 3 in which the container 10 has been removed, and also in FIG. 1 as identified in the broken away portion. The first recess 28, outermost within the area between the bifurcated arms 14, 16, is provided for clearance of the bottom portion of the container 10 pivotably mounted to the arms 14 and 16, when the container is in free hanging position, and for outward pivotal movement when the centrifuge begins rotation. The recess 28 may have a shelf extending below the container 10 as shown, or be left open. A second recess 30 formed in the upper surface of the yoke portion 18 of the rotor provides clearance for the innermost upper portion of the container 10 with the sample load 12, when the centrifuge is operating ar high rotational speed and the container 10 has pivoted to a substantially horizontal position due to application of high centrifugal force field. This container position is shown in FIG. 3 for all containers 10 with sample loads and in FIG. 1 for the container and load identified as 10' and 12', respectively.

Between the first and second recesses, 28 and 30 respectively, a support rib 31 is formed which ties the interior of each arm 14 and 16 to each other for increased lateral support between the bifurcated upright arms to reduce bending stresses.

Figure 2:
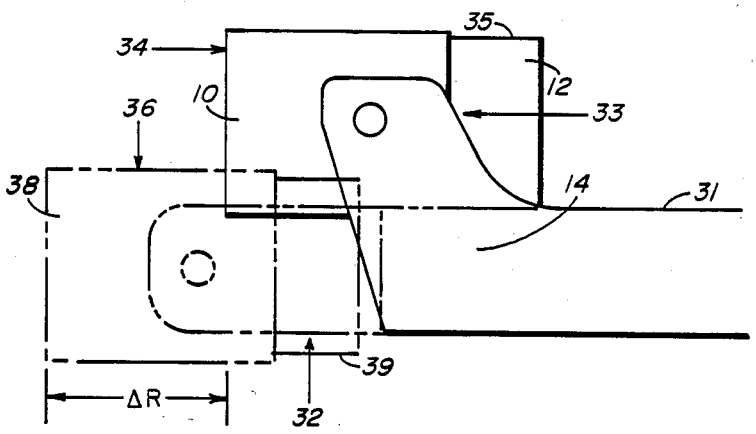
FIG. 2 is a comparison of the present invention construction under effect of a centrifugal force field, shown in solid line, and a prior art construction of a rotor and container assembly under effect of a centrifugal force field, as shown by broken line.

Benefits of the offset pivotal mounting position of the container on the rotor arm are described with reference to FIG. 2. In FIG. 2, the present invention providing an offset pivotal mounting for a sample container 10 between adjacent centrifuge rotor arms 14 and 16, is shown in solid line and indicated generally by 33. A prior art design for pivotally mounting a container between rotor arms is shown in the broken line portion, indicated generally by 32. Both portions of this figure show a sample container in a substantially horizontal position, a position the container would obtain when affected by a high centrifugal force field. It can be easily understood from the figure that the offset pivotal mounting position provided by the present invention substantially reduces the diameter of the rotor assembly. Specifically, comparing the outermost end 34 of a container 10 mounted to the inventive rotor assembly, to the outermost end 36 of a container 38 mounted to a prior art rotor assembly, the difference in radial position is indicated by $\Delta R$. The inventive rotor assembly 33 is reduced in surface area exposed to surrounding air, reducing the effect of windage drag. More importantly each arm-container assembly is reduced in radius by the amount $\Delta R$. This substantially reduces the average tangential velocity of the exposed surfaces according to the equation:

$$V = Wr$$

where, $V$ = tangential velocity $W$ = angular velocity or rotational sped $r$ = radius Thus reduction in radius is directly proportional to reduction in tangential velocity, which has an effect on windage drag. Though the reduced radial position of the container 10 on the inventive pivotal mount 33 as compared to the container 38 between mount 32, reduces the centrifugal force field generated on the container 10, the difference in surface area, due to the more compact design of the improved rotor design and the reduced windage drag, permit an increase in rotor speed. An increased rotor speed has much greater effect on the centrifugal force field generated than it has on increase in tangential velocity and thus windage drag, as is shown by the equation $$CF = K\ Wrn^2$$

where,

K = constant
W = weight
r = radius
n = rotational speed in which the rotor speed is shown to have an effect on the generated centrifugal force measured by a power of 2, an exponential relationship. Referring again to Equation 1, rotor speed has a direct relationship with tangential velocity, i.e., windage drag. Thus centrifugal force is increased by a power of 2 over increases in tangential velocity and an effect on windage drag.

Referring again to FIG. 3 which depicts a top view of a rotor and container assembly, the uppermost portions 35 of each of the sample, containers holding a sample load can obtain much closer proximity due to the fact that the pivotal mounting of the present invention is upwardly offset from the radial plane of maximal strength of the rotor body. This allows each of the containers 10 to pivot into a position substantially above the upper surface 31 of the rotor yoke 18, tilting the uppermost portion of each container 10 inwardly in a fashion that does not require the uppermost portions 35 of the containers and sample loads to enter between the bifurcated arms 14, 16 as is necessary with prior designs. This enables the containers to be mounted in a smaller diameter relationship on the offset mount type rotor, reducing surface area exposed. This relationship can also be seen with reference to FIG. 2 in which the upper portion 35 of the container 10 with sample load, is positioned substantially above the upper surface 35 of the yoke 18 with the inventive pivotal mount 33, as compared to the intermediary position of the upper portion 39 of the container 38 with sample load between rotor arms with the prior art pivotal mount 32. The closer proximity positions of the container 10 in operational position is a distinct advantage because it reduces the surface area and radial position of the containers 10 exposed, thus minimizing windage drag and permitting higher rotor speeds. As can be seen from FIG. 2, in prior art designs by requiring the uppermost portion 39 of the container 38 with sample load to enter between the bifurcated arms of a rotor, the rotor arms must be substantially longer increasing the weight of and stress on the rotor when a centrifugal force field is generated. Further, it can be easily seen that this substantially increases surface area exposed, and thus windage drag on the rotor.

Returning to the description referencing FIG. 3, each of the container stations is identically constructed. Though the rotor-container assembly is shown with four container stations, the offset pivotal mounting for a sample container, and the rotor construction described herein, may be used with any plural number of containers provided proper rotor balance is maintained.

I claim:

1. A rotor assembly comprising:

a rotor yoke having a plurality of substantially L-shaped bifurcated arms radially extending from the center of the rotor yoke;

the arms defining a pair of upright ends extending radially outward and perpendicular to the plane of rotation;

a pair of pivot pins, each extending inwardly from each bifurcated arm and thereby providing a structure for supporting a sample container;

the pivot pins being positioned within each arm to establish an offset fixed pivot in accordance with a relationship, so that the position of said pin within each arm is a function of the tangential velocity of the rotor, so the rotor container assembly is of substantially reduced diameter.

2. A rotor for a centrifuge having a plurality of pairs of outwardly extending bifurcated arms, each arm having an end portion which extends upwardly to provide a location for supporting a mounting pin, each pair of arms supporting a pair of opposing pins inwardly directed and aligned, a first recess formed between each pair of extending bifurcated arms for receiving a lower portion of a sample container in each a free-hanging position, and a second recess formed in the upper surface of said rotor (centrally positioned relative to said bifurcated arms) for receiving an upper portion of said sample container during operational periods of said rotor, said pins being upwardly offset from said rotor to provide a pivotal mount for a sample container which permits the sample container to pivot about an axis offset from a radial plane of maximal strength of said rotor in response to a centrifugal force, whereby the radial length of said rotor arms is minimized.

3. The rotor defined in claim 2 additionally comprising a rib portion defined between said first and second recess and extending between said bifurcated arms to provide lateral support for said bifurcated arms.

4. A rotor for a centrifuge having a plurality of pairs of outwardly extending bifurcated arms, each arm having an end portion which extends upwardly, a sample container mounting means supported by each of said end portions, a first recess formed between each pair of extending bifurcated arms for receiving a lower portion of a sample container when in a free hanging position, and a second recess formed in the upper surface of said rotor and centrally positioned relative to said bifurcated arms for receiving an upper portion of said sample container during operational periods of said rotor, said mounting means being upwardly offset from said rotor to provide a pivotal mount for a sample container which permits the sample container to pivot about an axis offset from a radial plane of maximal strength of said rotor in response to a centrifugal force, whereby the radial length of said rotor arms is minimized.

* * * * *